US006590835B2

(12) United States Patent
Farine et al.

(10) Patent No.: US 6,590,835 B2
(45) Date of Patent: Jul. 8, 2003

(54) PORTABLE OBJECT WITH A WRISTBAND INCLUDING A KEYBOARD

(75) Inventors: Pierre-André Farine, Neuchâtel (CH); Jean-Jacques Born, Morges (CH); Jean-Pierre Mignot, Peseux (CH)

(73) Assignee: Asulab S.A., Marin (CH)

( * ) Notice: Subject to any disclaimer, the term of this patent is extended or adjusted under 35 U.S.C. 154(b) by 0 days.

(21) Appl. No.: 09/873,381

(22) Filed: Jun. 5, 2001

(65) Prior Publication Data

US 2001/0050883 A1 Dec. 13, 2001

(30) Foreign Application Priority Data

Jun. 7, 2000 (CH) ..... 1120/00

(51) Int. Cl.[7] ..... G04B 47/00; G04B 37/00; A44C 5/00

(52) U.S. Cl. ..... 368/10; 368/281; 368/282

(58) Field of Search ..... 368/281–282

(56) References Cited

U.S. PATENT DOCUMENTS

| | | | | |
|---|---|---|---|---|
| 4,141,074 A | | 2/1979 | Popper | |
| 4,255,801 A | * | 3/1981 | Ode et al. | 368/10 |
| 4,847,818 A | * | 7/1989 | Olsen | 368/10 |
| 2,254,454 A | * | 7/1992 | Sherer | |
| 5,220,521 A | * | 6/1993 | Kikinis | 708/138 |
| 5,416,730 A | * | 5/1995 | Lookofsky | 361/680 |
| 5,528,559 A | | 6/1996 | Lucas | |

FOREIGN PATENT DOCUMENTS

GB 2254454 A * 7/1992

OTHER PUBLICATIONS

Patent Abstracts of Japan, vol. 005, No. 138, Sep. 2, 1981 & JP 56 074765, Jun. 20, 1981.

Patent Abstracts of Japan, vol. 010, No. 074, Mar. 25, 1986 & JP 60 211560, Oct. 23, 1985.

Patent Abstracts of Japan, vol. 014, No. 585, Dec. 27, 1990 & JP 02 253189, Oct. 11, 1990.

Patent Abstracts of Japan, vol. 001, No. 058, Jun. 6, 1977 & JP 52 002120, Jan. 8, 1977.

* cited by examiner

*Primary Examiner*—David Martin
*Assistant Examiner*—Michael L. Lindinger
(74) *Attorney, Agent, or Firm*—Sughrue Mion, PLLC

(57) ABSTRACT

A wristwatch (1) includes a keyboard whose control keys (4) are distributed over the length of the wristband (3), a processing unit (19) for data introduced via the keyboard, at least one display device (6) for displaying time functions and/or data provided by the processing unit, and a power source for the electric power supply of the electronic components of the wristwatch. In order to allow the use of its keyboard, the wristwatch (1) is placed on a work surface, the length of the wristband (3) facing a user. The display of the alphanumerical characters (7*a*) occurs in the direction of the length of the wristwatch, i.e., rotated by 90° with respect to the usual time display (7*b*). At least one integrated encoding circuit (9) acts as a communication interface between the keys (4) of the keyboard and the processing unit (19) integrated in the case of the wristwatch. The encoding circuit is placed in the wristband (3) and communicates with the unit via one of the two electric supply wires of said circuit. The distribution of the keys of the wristband may change as a function of a determined country.

20 Claims, 2 Drawing Sheets

PORTABLE OBJECT WITH A WRISTBAND INCLUDING A KEYBOARD

BACKGROUND OF THE INVENTION

The present invention concerns a portable object with a wristband including a keyboard provided with control keys bearing symbols oriented such that they can be read in the direction of the length of the wristband, said keys being distributed over the length of the wristband, a processing unit for data introduced using the keyboard, at least one display device for displaying, in the direction of the length of the wristband, characters introduced using the keyboard and processed by the processing unit, and a power source for the electric power supply of the electronic components of said object. Preferably, the portable object is a wristwatch.

Various portable objects, such as wristwatches, wristbands, alarm signal emitting devices, devices with a compartment for storing accessories or products, or other devices, are usually worn on the wrist by most people. Since these people generally feel the need to know the time wherever they are wristwatches are the most commonly used objects for daily activities.

In addition to the conventional provision of the time and the date, many embodiments of wristwatches have been proposed with additional functional devices, such as for example a calculator, an altimeter, a thermometer or other elements. These additional devices incorporated in said watch provide the advantage of avoiding the need to carry other separate portable devices which are liable to be lost or forgotten.

The use of a calculator combined with a wristwatch may be useful for various professional activities or for leisure when it necessary to calculate for example prices, amounts of bank interest or certain quantities of products. GB Patent No. 1 574 730 discloses an electronic watch provided with such a calculator. In order to do this, the keys of the calculator are arranged on the two strands of the metal wristband close to the watch case so that they can be easily handled by the fingers of the wearer of the watch while figures shown on a digital display complementary to the digital time and date display are visible. All the keys are connected to a central processing unit which is located inside the watch case by a strip of conducting wires passing through the case. A battery is also placed in the wristband for the electric power supply of the calculator.

All the keys have to be close to the watch case to facilitate the use thereof and for a person wearing said watch to check the figures and operations shown on the display. The symbols on the keys are arranged to be able to be readable in a direction equivalent to the reading of the time on the display device given that the calculator is used when the watch is being worn.

The requirement for the keys to be close to the case means that there are only a restricted number of keys to be pressed able to be activated by the user's fingers. It is thus inconceivable to think of adding a number of keys equivalent for example to an alphanumerical keyboard in a configuration such as presented in this document, or, conversely, by reducing the size of the keys which would make the use thereof inconvenient. Moreover, the electric connection of said keys to a central unit using a strip of numerous conducting wires passing through the case means that the wristband cannot be changed.

Another example of a portable object with a wristband including a calculator is disclosed in Japanese Patent No. 52-0021 120. Several control keys of a calculator keyboard are arranged on one of the wristband strands with the peculiarity of having symbols oriented such that they can be read in the direction of the length of the wristband. When the portable object is placed on a work surface, the display device in the case of the object also allows data introduced via the keyboard to be displayed in the direction of the length of the wristband. All the keys of the keyboard are connected by metal paths to a processing circuit integrated in the case of the object so that the circuit processes the data received to display it on the display device.

A major drawback of this embodiment lies in the fact that a multitude of metal paths have to pass through the case of the object to connect the processing circuit even in the case of a calculator. In the event that the wristband includes computer keyboard keys, the number of metal paths which have to connect the keys to the processing circuit becomes too large, which poses a problem for the connection between the wristband and the case of the object.

Another drawback is that this multitude of paths passing through the case poses watertightness problems and when the wristband is changed, if one wishes to change the type of control keys. The wristband would in this latter case have to be changed by a specialist which is a drawback.

In the same technical context, Japanese Patent No. 56-074765 discloses a wristwatch of the calculator type. The keys of the control keyboard are arranged on the two strands of the wristband on each side of the watch case. In order to facilitate the use of the calculator, control buttons arranged on the watch case allow the direction of display of a display device to be changed.

Since the two strands of the wristband carry keyboard keys, there must be metal paths passing through two opposite sides of the case to connect each key to a processing unit housed in the case which is double drawback. Moreover, another drawback is that in order to change the wristband as a function of a desired type of keyboard, a specialist is required.

An embodiment of a wristwatch with a set of keys bearing figures and letters has been proposed in GB Patent No. 2 254 454. The set of keys forms part of a structure which extends along the arm and which also constitutes the case of said watch. The user of said watch can introduced alphanumerical characters on a liquid crystal display, using the keyboard keys in a direction equivalent to the time indication, i.e. perpendicular to the length of the wristband.

Such a wristwatch has several drawbacks, since it is cumbersome and unattractive, and can be inconvenient for the wearer of the watch, since all the keys have to be accessible and readable while allowing the introduction made on the display to be able to be seen. Since the watch is worn on the wrist when said keyboard is used, a single hand may be used to be able for example to type messages.

SUMMARY OF THE INVENTION

One object of the invention is to provide a portable object with a wristband provided with a keyboard with control keys overcoming the aforecited drawbacks of the prior art and which is user friendly and easy to manufacture.

Another object of the invention consists in providing an interface for the transfer of data between the keys placed on the wristband and a processing unit housed in the case of the object which overcomes the drawbacks of the prior art and which does not pose any problem when the wristband is changed.

These objects, in addition to others, are achieved by the aforecited portable object which is characterised in that at least one integrated encoding circuit is placed in the wristband in order to act as a communication interface between the keys of the keyboard and the processing unit which is integrated in a case of the object.

One advantage of the portable object according to the invention consists in that once it is removed from the wrist, it can be placed flat on a suitable work support, the letters and figures marked on each key being oriented in the direction of the length of the wristband, said length of said wristband facing the user, in order for data to be able to be introduced using the keyboard.

The length of the wristband on which the keys of the keyboard are placed, may be equivalent to the dimension occupied by the letters of a conventional computer keyboard. The position of the letter keys corresponds to that of said conventional keyboard to avoid creating any problem of operating the keys by the fingers of a user used to working on a personal computer.

Another advantage of the portable object is that an encoding circuit can be placed on each strand of the wristband. Said circuit receives the information introduced by one or other of the keys and transmits, via a two wire connection to the interface arranged between the wristband and the case, all the data to be processed by a processing unit in order for them to be able to be displayed. The data transmitted to the processing unit on one of the two power supply wires of the integrated encoding circuit are voltage pulses added or subtracted to or from the supply voltage Vdd of said integrated encoding circuit. This encoding circuit thus allows the number of connection wires at the interface between the wristband and the case of the portable object to be limited.

The portable object may be a wristwatch, a wristband with a display device, a device for transmitting alarm signals, a device with a compartment for storing accessories or products or another device having a keyboard with control keys.

Another advantage of the portable object as a wristwatch is that the display of the information introduced by the keyboard occurs in the direction of the length of the watch since the watch is placed on a work surface with the length of the wristband facing the user. If the watch includes a digital display for time functions, the display of said information is thus rotated by 90° with respect to the display of the usual time functions when the watch is worn on the wrist. No action on one or other of the keys of the keyboard automatically causes a time function display. Only repeated action on the keys causes the switching between the time display mode and the data entry mode so as to make the information introduced readable.

BRIEF DESCRIPTION OF THE DRAWING

The objects, advantages and features of the portable object with a wristband including a keyboard with control keys will appear more clearly in the following description of embodiments illustrated by the drawings, in which.

DETAILED DESCRIPTION OF THE INVENTION

The following description will be limited to embodiment examples of portable objects with a wristband in the form of wristwatches with keyboards and control keys which are the most commonly used without thereby being limited to these embodiments. Moreover, all the components or electronic units which form the various parts of said watch and which are known to those skilled in the art in the field of horology will not be described in detail. Only said components necessary to the elaboration of preferred embodiments of said watch according to the invention will be described.

Figure 1A:
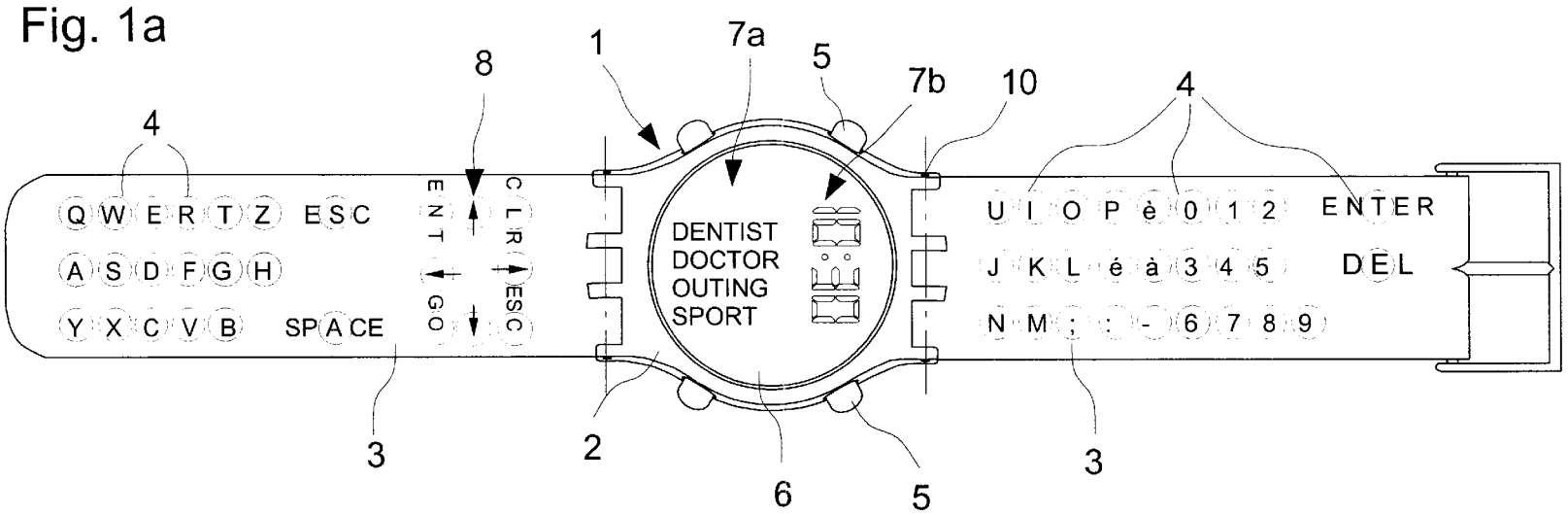
FIG. 1*a* shows a first embodiment of the portable object as a wristwatch with a keyboard and control keys according to the invention including a flexible nonmetal wristband.

FIG. 1*a* shows schematically a first preferred embodiment of a wristwatch with a digital display of the time and the date. This watch 1 is formed of a case 2 housing in particular the time-keeping circuit, not visible in the Figures, a conventional liquid crystal display device 6 of the dot-matrix type enclosed under a protective glass secured to the case and a power source for the electronic components of said watch 1, which is for example a battery or an accumulator which can be recharged by any means known within the technical field of the invention. The case is preferably made of plastic material.

A wristband 3 including two strands is mounted in a removable and rotatable manner about a rotational axis 10 on two opposite sides of case 2 of watch 1. The ends of wristband 3 opposite to the connection to case 2 include buckle fastening means for securing the watch to a user's wrist, said means being separable to be able to place the watch on a work surface, for example a flat surface, when the alphanumerical keyboard is used. Any type of securing means other than those illustrated in FIG. 1*a* and known to those skilled in the art within the technical field of the invention may be provided on condition that they can be separated.

As a general rule the length of each strand of the wristband is not equal, while for the purpose of simplification, FIG. 1*a* shows them as being of equal dimensions.

Three rows of more than 40 keys 4 of a keyboard formed mainly of alphanumerical characters are placed on the two strands of said wristband 3. The dimension of keys 4 which are regularly spaced over the wristband must be selected so as to allow a user's fingers to activate one or other of said keys separately. The marking of the letters and figures on keys 4 are readable in the direction of the length of the watch, i.e. rotated by 90° with respect to the conventional time display on a digital watch. The keys representing the letters of the alphabet are arranged in an identical manner to those of a conventional computer keyboard to allow the easy introduction, for example using two hands, of messages to be displayed on the display device 6 in the direction of the length of the watch when the latter is placed on a suitable flat work surface.

Wristband 3 is preferably formed of a rubber-like material so that it does not curve upwards when it is removed from the user's wrist and placed on the flat work surface. The dimension in length of the wristband corresponds to the dimension occupied by the letters of a conventional computer keyboard, whereas its width may be of the order of 3 cm.

The first strand of wristband 3 includes, in addition to the 17 letters and ESC and SPACE keys shown in FIG. 1*a*, keys 8 for controlling the watch functions. Keys 8 which are eight in number in FIG. 1*a* may be used for example for setting the time and date in horizontal display mode 7*b*, for setting an alarm, for displaying, moving, storing and deleting messages introduced into vertical display mode 7*a*, i.e. in the direction of the length of the watch. Said keys 8 may also be used for passing from a horizontal display mode to a vertical display mode or vice versa. Of course, control buttons 5 shown as being four in number in FIG. 1*a* may also perform equivalent functions to keys 8 in particular as regards the time functions.

Normally without any action on one of keys 4 bearing the alphanumerical characters after a predetermined duration for example of 1 minute, the watch indicates the time and/or the date in a horizontal display mode 7*b*. Vertical display mode 7*a* is only activated by pressing at least one key 4 during a certain time period when the watch is removed from the wrist and placed on a work surface in order to avoid any inadvertent pressure on a key 4 against a surface triggering vertical display mode 7*a* which results for example in the display of the time and/or date being momentarily removed.

Wristband 3 bearing the keys of keyboard 4 and the function keys 8 may be changed as a function of the type of computer keyboard depending on the use of said watch in different countries.

The transmission of the electric signals originating from the operation of the key of the wristband to a central processing unit integrated in the watch case will be explained in detail in the following description made with reference to FIGS. 2 and 3.

Figure 1B:
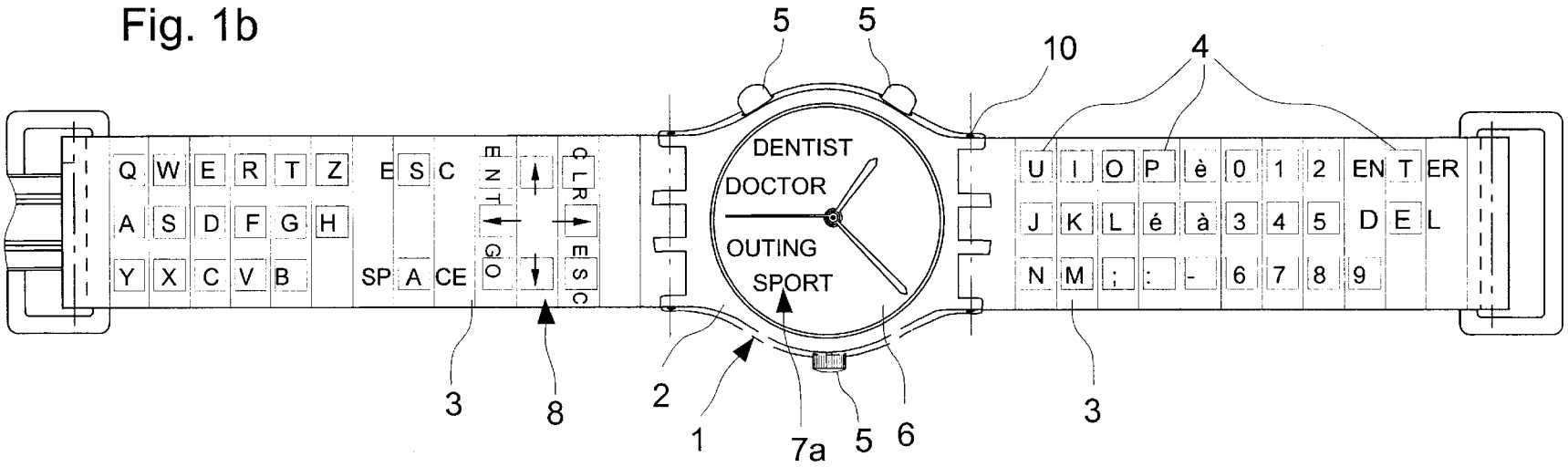
FIG. 1*b* shows a second embodiment of the portable object as a wristband with a keyboard and control keys according to the invention including a wristband with metal links.

FIG. 1*b* shows a second embodiment of a wristwatch with a computer keyboard. The elements of this Figure, which correspond to those of FIG. 1*a*, bear identical references.

Electronic wristwatch 1 of the analogue type includes a metal case 2 housing in particular a time-keeping circuit, which is not visible in the Figures, and a stepping motor combined with a gear train for driving hands 16 indicating the time, a conventional liquid crystal display device 6 of the dot-matrix type forming the dial of the time display by hands 16, said display device 6 being enclosed under a protective glass secured to the case, and a power source for the electronic components of said watch 1, which is for example a battery or an accumulator able to be recharged by any known means within the technical field of the invention.

Wristband 3 which is in two parts in this second embodiment is made of metal and formed of links carrying the computer keyboard keys 4 or function control keys 8 as explained with reference to FIG. 1*a*. Most of the links each carry three keys 4 or 8. It is to be noted that as a general rule, the length of each strand of the wristband is not equal, whereas for the sake of simplification, FIG. 1*b* shows each strand as being of equal dimensions.

A flexible band, not visible in FIG. 1*b*, bearing metal paths is provided for the electric connection of the keys with a processing unit integrated in watch case 2. This band passes through each link of the wristband and is electrically insulated from each metal part of the links.

The bottom part of each key 4 or 8 of parallelepiped shape includes an outer edge which rests against the inner edge of a corresponding opening provided on each link for the passage of said key. Each key is held in this position away from the band by conventional return means which may be for example either a spring, or an annular rubber-like element. A disc made of metal or a conductive carbon-based material is placed under the bottom part of each key to short-circuit two metal paths when the key is pressed and to give the corresponding electric command to the processing unit of the symbol to be displayed.

As explained with reference to FIG. 1*a*, the ends of wristband 3 opposite to the connection to case 2 include securing means which must be able to be separated in order to be able to place the watch on a flat surface when the computer keyboard is used.

The function control keys 8, and control buttons 5 which include in particular a time and/or date adjusting crown, can fulfil the same functions explained with reference to the first embodiment of FIG. 1*a*.

Figure 2:
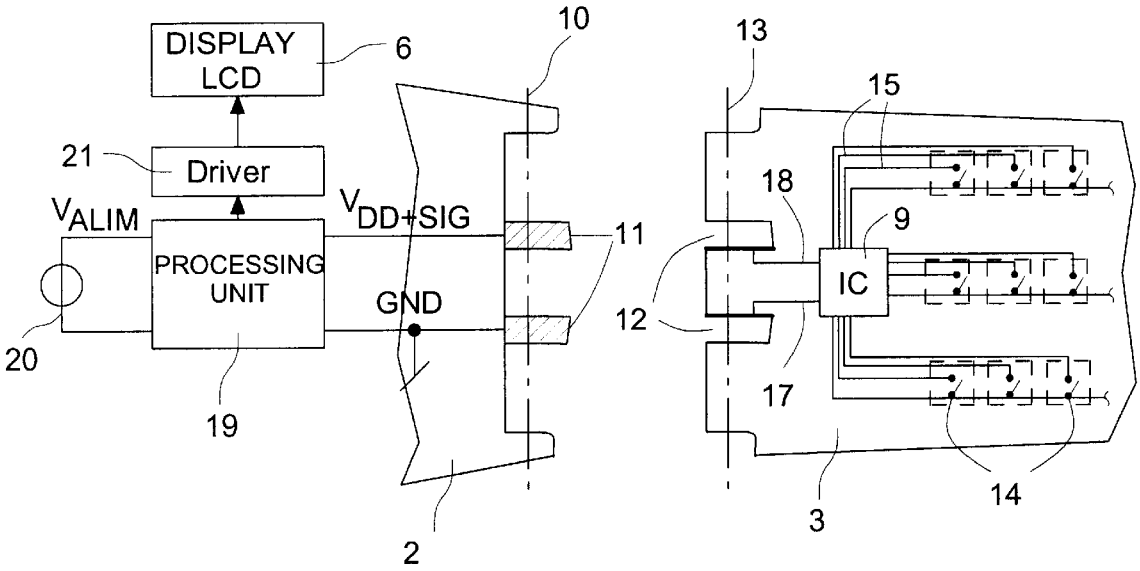
FIG. 2 shows schematically a part of the wristwatch of FIG. 1*a* with the electronic elements and their connections.

FIG. 2 shows schematically the electronic components necessary for the transmission of the electric signals between the computer keyboard keys or the function keys and the components integrated in watch case 2.

The two strands of wristband 3, only one of which is shown in FIG. 2, each include an integrated encoding circuit 9 close to the end of wristband 3 connected to watch case 2. The integrated encoding circuit is connected on the one hand by metal paths 15 to a series of switches 14 formed by each of the computer keyboard keys or watch function control keys, and on the other hand by two metal paths 17 and 18 to two conductive notches 12 at the end of wristband 3 connected to watch case 2. The width of each metal path may be of the order of 0.15 mm. One or other of switches 14 are closed by pressing the corresponding key thus giving the key symbol information to integrated encoding circuit 9.

When the wristband is secured to the case by a plastic pin passing through transverse openings 10 and 13, the two notches 12, at least one of whose walls is conductive, comes into mechanical contact with two metal sockets 11 of complementary shape coming out of plastic watch case 2 for the transmission of the electric power supply and data.

In the watch case, a processing unit 19 is powered at a voltage Valim by an electric power source 20 formed by battery or an accumulator. Processing unit 19 communicates with each integrated encoding circuit 9 via two supply lines. After wristband 3 has been connected to watch case 2, the first supply line GND connects metal path 17 in the wristband, whereas the second transmission line VDD+SIG connects metal path 18.

By pressing one of the keyboard or function keys, the corresponding switch 14 closes short-circuiting two respective metal paths 15. From this moment on, encoding circuit 9, supplied with voltage by the two metal paths 17 and 18, receives the command from the key pressed and transmits to processing unit 19 the information relating to the key pressed in serial form by modulating supply voltage VDD+SIG on line 18.

Said integrated encoding circuit is formed of a clock signal generating unit, a 4-bit microprocessor whose clock is provided by the oscillator unit or a hard wired logic for sending in series on line 18 the binary word corresponding to the symbol of the key pressed so that this work is processed by the processing unit.

The frequency generated by the charge and discharge of an integrated capacitance of each clock signal generating unit of the encoding circuits is fixed approximately at 32 Khz with a margin of error of ±20% so as to be able to modulate the signal corresponding to the key pressed on the supply voltage destined for the processing unit integrated in the watch case. The variation of this frequency from one circuit to another does not influence recognition of the character introduced by the keyboard into the processing unit.

In processing unit 19, switching means can be provided in order to control the passage from the horizontal time and/or date display mode to the vertical message display mode.

These switching means are activated for example as soon as one of the computer keyboard keys is pressed for a sufficient period of time to avoid switching from the horizontal mode to the vertical mode during a shock when the watch is worn on the wrist.

The fact of providing each strand of wristband 3 with an integrated encoding circuit 9 allows the number of electric connection wires at the interface between wristband 3 and watch case 2 to be reduced, and to avoid creating any problem when the wristband is changed. Two wires alone are sufficient for the electric power supply of said circuit and for the transmission of data, which is well known within the technical field of the invention.

The processing unit, which may be a microcontroller clocked at a frequency of the order of 32 KHz provided by a quartz oscillator unit which is not visible in the Figures, transmits a command corresponding to the symbol of the key pressed to a drive circuit 21 of display device 6 so as to be able to display said symbol or character on the display device. It is to be noted that the oscillator unit with a division chain can be shared with the time-keeping circuit of the watch.

Once the message or messages have been typed in particular by the alphanumerical character keys and displayed on several lines of liquid crystal display device 6, it is possible to store the messages, automatically or by activating the function keys or the watch control buttons, in a memory of the processing unit in order to be able to display them in a future operation in vertical display mode. The stored messages may also be transmitted by a wireless link using radiofrequency transmission and/or reception means to a work station. The transmission and/or reception means include an antenna for example integrated in the watch case for transmitting and/or receiving data via radiofrequency signals.

Since the messages introduced may also be used for an electronic diary, the processing unit may be connected to an alarm device controlled by electronic elements of the time-keeping circuit for storing an alarm time and date in order to indicate the event at the stored time and date by acoustic means or by displaying the corresponding message in vertical mode.

It goes without saying that the characters displayed on the display device can correspond to mathematical operations. In these conditions, the processing unit can supply the result of the calculations introduced by the keyboard keys as for a calculator.

Figure 3:
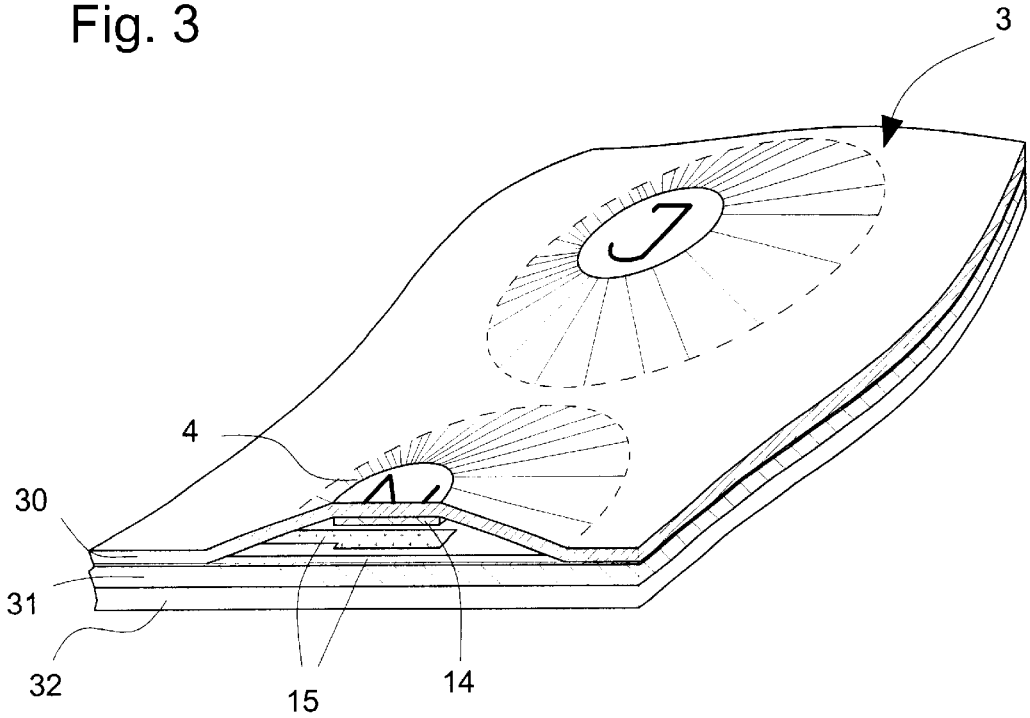
FIG. 3 shows a three-dimensional partial cross-section of a key of the wristband of the watch of FIG. 1*a*.

FIG. 3 shows a partial cross-section of a key 4 of an alphanumerical key of the first embodiment. As explained with reference to FIG. 1*a*, wristband 3 is mainly made of a rubber-like material.

A strip of flexible printed circuit 31, for example a Kapton® film, carrying copper metallic wires 15 on at least one face is enclosed between two layers of rubber-like material 30 and 32. The first layer 30 is shaped to form said keys 4, whereas the second layer 32, intended to come into direct contact with the wrist of a wearer of the watch, acts as a base for strip 31.

Making the metal paths directly on layer 32 without the aid of the printed circuit strip can also be envisaged, but given the resilience of the rubber-like layers 30 et 32, an extension of the wristband can lead the paths to break.

Each key 4 in the shape of a truncated cone includes under its top part a metal disc or a carbon-based conductive disc 14 which is held away from the metal paths in the rest state. By pressing on the top part of one of keys 4, disc 14 as a switch short-circuits two metal paths 15 in order to send a command corresponding to the symbol of said pressed key to the integrated encoding circuit. By releasing said key 4 which was previously pressed, the resilience of the rubber-like material allows the key to be returned to a rest position, i.e. away from strip 31.

Of course, other shapes for each keyboard or function control key may be realised while maintaining the disc away from the strip without pressing on the corresponding key. Even when the wristband is bent when the watch is worn on the wrist, conductive disc 14 is held sufficiently far away from metal paths 15 to avoid introducing commands without deliberate action on one of the keyboard keys.

In an alternative embodiment which is not shown in the Figures, the keyboard and function keys arranged on the two strands of the wristband can be capacitive keys or piezo-resistive keys. In the first case, the information transmitted to the integrated circuit relates to a variation in said capacitance by the approach of a user's finger, whereas in the second case, it relates to a variation in resistance by contact of a user's finger.

From the description which has just been made, multiple variants of the portable object provided with a keyboard with control keys can be conceived by those skilled in the art without departing from the scope of the invention. For example, instead of having a wristband with two strands, the portable object may include a wristband with a single strand one end of which is secured on one side of the case and the other end includes means for securing the wristband co-operating with complementary means arranged on an opposite side of the case of the object. The electric power source can also be placed in a housing of the wristband to power all the electronic components of the object, in particular of the wristwatch. This power source may also be formed of a power accumulator receiving power for example from solar cells exposed to a source of light.

What is claimed is:

1. A portable object with a wristband including a keyboard with control keys bearing symbols oriented so a to be able to be read in the direction of the length of the wristband, said keys being distributed over the length of the wristband, a processing unit for data introduced via the keyboard, at least one display device for displaying in the direction of the length of the wristband characters introduced using the keyboard and processed by the processing unit, and a power source for the electric power supply of the electronic components of said object, wherein at least one integrated encoding circuit is placed in the wristband so as to act as a communication interface between the keys of the keyboard and the processing unit which is integrated in a case of the object.

2. A portable object according to claim 1, wherein it constitutes a wristwatch, and wherein the display device allows time functions and/or characters provided by the processing unit to be displayed.

3. A portable object according to claim 1, wherein the keys of the keyboard are arranged over three rows in the direction of the length of the wristband, the keys bearing letter and punctuation symbols being arranged like a computer keyboard the configuration of which depends on the country of destination.

4. A portable object according to claim 1, wherein the integrated encoding circuit receives metal electric connection paths of the keyboard control keys and transmits to the processing unit electric signals representative of each character introduced by the keyboard keys on one of the two electric supply lines of said integrated circuit, said integrated circuit further including keyboard data which depends on the country of destination.

5. A portable object according to claim 4, wherein two notches at least one of whose walls is metal are provided at the end of the wristband secured to the case to be in contact with two complementary metal sockets of the case to establish an electric connection between the processing unit arranged in the case and the encoding unit arranged in the wristband.

6. A portable object according to claim 4, wherein the power source is a battery or an electric power accumulator arranged inside the case of the object for the electric supply of the processing unit of the display device and of the integrated encoding circuit.

7. A portable object according to claim 4, wherein the wristband is formed of two strands secured in a removable manner onto two opposite sides of the case, the keys of the keyboard being distributed over most of the length of the two strands, wherein it includes two integrated encoding circuits placed respectively on each strand in proximity to the case, the electric supply of each encoding circuit passing through complementary metal electric connection parts between one of the ends of each strand and the case of the object.

8. A portable object according to claim 2, wherein it includes a display device for the time functions of the analogue type and a digital display device for displaying the characters.

9. A portable object according to claim 8, wherein the digital display device constitutes the dial of the analogue display device.

10. A portable device according to claim 2, wherein the display device is a digital display device allowing the display of time functions in a direction perpendicular to the display of the characters.

11. A portable object according to claim 10, wherein switching means are provided for passing from the time function display to the character display when at least one key of the keyboard is pressed for a predetermined period of time.

12. A portable object according to claim 4, wherein the wristband includes a first and a second superposed layer made of a rubber-like material so that the entire length of said wristband rests on a work surface when the keyboard is used, the metal paths for connecting each key to the respective integrated circuit, and said integrated circuit being inserted between the two layers of rubber-like material.

13. A portable object according to claim 12, wherein the metal paths are made on a flexible insulating film inserted between the two layers, the first surface of said film being secured to the first layer and the second surface of said film, which carries the metal paths, being secured to the second layer, and wherein the second layer includes protuberances to define each key of the keyboard, conductive discs being placed on the inner surface of the protuberances and held at a distance from the metal paths without any pressure on said protuberances, each disc being used to short-circuit two metal paths when a keyboard key is pressed to give information to the integrated circuit of the symbol corresponding to the key pressed.

14. A portable object according to claim 4, wherein the wristband is formed by metal links carrying the keys of said keyboard (4) and mechanically and electrically connected to each other for the electric connection of each key to the respective integrated circuit.

15. A portable object according to claim 2, wherein keys for controlling the functions of said watch are arranged on the wristband.

16. A portable object according to claim 1, wherein the processing unit includes means for storing data introduced through the keyboard in order to be able to display the data stored on the display device by pressing a control button arranged on a case of the object or a function control key arranged on the wristband.

17. A portable object according to claim 16, wherein means for transmitting and/or receiving radiofrequency signals connected to the processing unit are provided in the case of the object for transmitting data introduced by the keyboard and stored in storage means to a work station provided with means for reading the radiofrequency signals or for receiving data by radiofrequency signals to be processed by the processing unit.

18. A portable object with a wristband, comprising:

a keyboard with control keys bearing symbols oriented so as to be able to be read in the direction of the length of the wristband, said keys being distributed over the length of the wristband, a processing unit for data introduced via the keyboard, at least one display device for displaying, in the direction of the length of the wristband, characters introduced using the keyboard and processed by the processing unit, and a power source for the electric power supply of the electronic components of said object, wherein at least one integrated encoding circuit is located in the wristband so as to act as a communication interface between the control keys of the keyboard and the processing unit which is integrated in a case of the object, and wherein the integrated encoding circuit receives metal electric connection paths of the keyboard control keys, and transmits to the processing unit electric signals, representative of each character introduced by the control keys, on one of two electric supply lines of said integrated circuit.

19. The portable object according to claim 18, wherein two notches, at least one of whose walls is metal, are provided, at a wristband end secured to the case, to be in contact with two complementary metal sockets of the case to establish an electric connection between the processing unit, located in the case, and the encoding unit located in the wristband.

20. A portable object with a wristband, comprising:

a keyboard with control keys bearing symbols oriented so as to be able to be read in the direction of the length of the wristband, said keys being distributed over the length of the wristband, a processing unit for data introduced via the keyboard, at least one display device for displaying, in the direction of the length of the wristband, characters introduced using the keyboard and processed by the processing unit, and a power source for the electric power supply of the electronic components of said object, wherein at least one integrated encoding circuit is placed in the wristband so as to act as a communication interface between the keys of the keyboard and the processing unit which is integrated in a case of the wristwatch, and wherein the integrated encoding circuit is formed of a clock signal generating unit, a microprocessor clocked by an oscillator unit and hard-wired logic for sending in series binary words, corresponding to a symbol of a pressed key, on only one of two supply lines of the integrated circuit.

* * * * *